United States Patent [19]

Racine

[11] 3,992,733

[45] Nov. 23, 1976

[54] FURNISHING ARTICLE OF FOAM MATERIAL

[75] Inventor: Georges Racine, Nice, France

[73] Assignee: Georges Racine, Nice, France

[22] Filed: May 24, 1974

[21] Appl. No.: 473,215

[30] Foreign Application Priority Data

May 29, 1973 France ..... 73.19501

[52] U.S. Cl. ..... 5/337

[51] Int. Cl.[2] ..... A47G 9/00

[58] Field of Search ..... 5/338, 340, 345, 337, 5/334 C

[56] References Cited

UNITED STATES PATENTS

| | | | |
|---|---|---|---|
| 793,476 | 6/1905 | Van Duzer | 5/340 |
| 1,704,182 | 3/1929 | Ellery | 5/343 |
| 3,234,569 | 2/1966 | Stewart | 5/338 |
| 3,290,702 | 12/1966 | Seltzer | 5/334 |
| 3,719,185 | 3/1973 | Hanes | 5/340 |

*Primary Examiner*—Werner H. Schroeder
*Assistant Examiner*—Doris L. Troutman
*Attorney, Agent, or Firm*—Morton, Bernard, Brown, Roberts & Sutherland

[57] ABSTRACT

A furnishing article such as a seat, pouffe, sofa or cushion comprising at least one block of foam which reproduces the general shape of the article and a covering made of fabric which is elastic in at least one direction, the said covering being fitted with closure means.

1 Claim, 6 Drawing Figures

FURNISHING ARTICLE OF FOAM MATERIAL

This invention relates to furnishing articles of foam material such as, for example, seats, pouffes, sofas or cushions.

The primary aim of the invention is to provide a novel article of this type which is easy to manufacture.

The furnishing article in accordance with the invention essentially comprises at least one block of foam which reproduces the general shape of the article and a covering made of fabric which is elastic at least in one direction, said covering being fitted with closure means.

In a preferred embodiment, the covering is constituted by a tube fitted with a closure cord at each end.

A clear understanding of the invention will be gained from the following description, reference being made to the accompanying drawings, in which.

Figure 1:
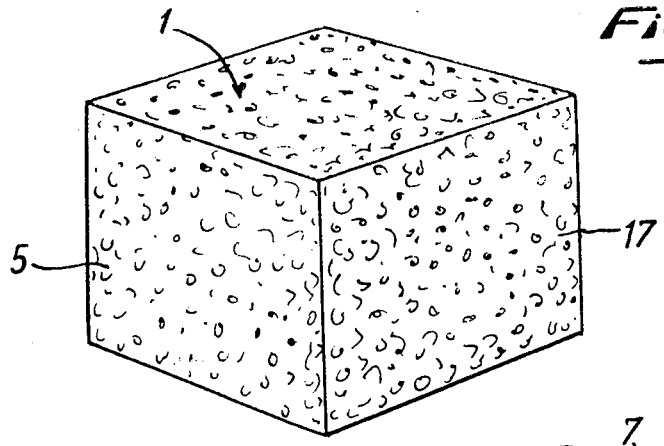
FIG. 1 is a perspective view of a foam block for the fabrication of a pouffe.
Figure 2:
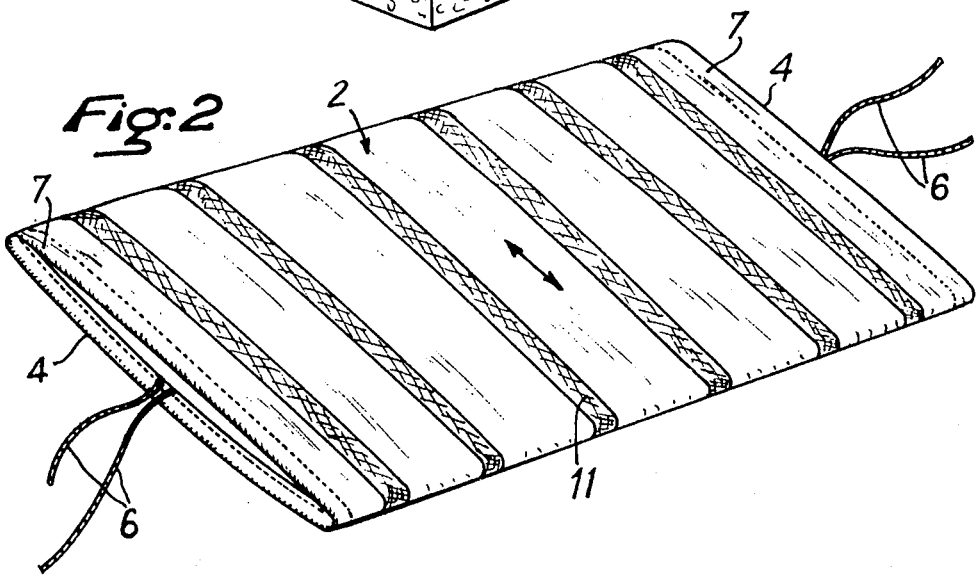
FIG. 2 shows a cover which is intended to surround the foam block of FIG. 1.
Figure 3:
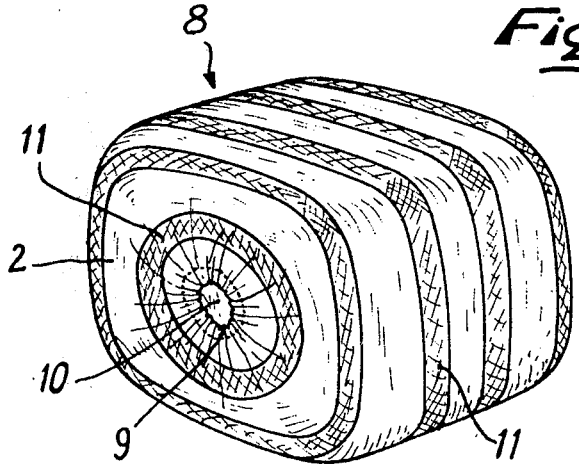
FIG. 3 is a perspective view of a pouffe formed with the foam block of FIG. 1 and the covering of FIG. 2.

Referring first to FIGS. 1 to 3, a pouffe manufactured in accordance with the invention will now be described. As shown in FIG. 1, provision is made for a foam block 1 which reproduces the general shape of the pouffe to be obtained. In the example under consideration, the block 1 has a parallelepipedal shape with sharp edges. By way of example, the foam is of the polyether type. In order to wrap the block 1 completely, provision is made for a textile cover 2 presented in the form of a tube. The said tube is formed either by sewing the two edges of a piece of woven material or by knitting on a circular knitting loom. The cover is intended to be endowed with transverse elasticity, namely at right angles to the axis of the tube as shown by the double arrow. The tube is preferably of the jersey type.

In order to obtain the desired shape of the pouffe, the cover 2 is given dimensions such that the foam block 1 is compressed when fitted within the cover. In other words, the perimeter of the cover as considered along the free edge 4 is smaller than the perimeter of the associated face 5 of the block 1 and the axial length of the tube is shorter than the half-perimeter of the corresponding face 17 of the block 1.

The tube 3 is open at both ends and fitted at each end with a cord 6 which is passed freely within the corresponding hem 7.

In order to fabricate the pouffe 8 of FIG. 3, the block 1 is placed within the tube 2 and the cords 6 are pulled until the contour of the extreme edges 4 is reduced to a very small circle 9. The two lengths of each cord 6 are tied in a knot and then tucked into the cover. In order to conceal the foam which is exposed to view within the circle 9, a piece of fabric 10 is previously placed in position between the cover and the foam. The said piece of fabric 10 remains in position of its own accord since it is securely held between the cover and the foam.

The shape of the pouffe 8 is derived from the shape of the foam block 1 by virtue of the transverse and longitudinal compressive stresses applied by the cover. The said compressive stresses are mainly evidenced by flattening and rounding-off of the edges of the foam block.

It is possible to form transverse strips 11 on the cover 2 so as to produce a ring effect on the closure faces or alternatively longitudinal strips which produce an effect of radial spokes on the said faces.

In an alternative foam of construction, the cover 2 may be provided with only one cord 6 and can be closed at the other end in much the same manner as a bag.

Figure 4:
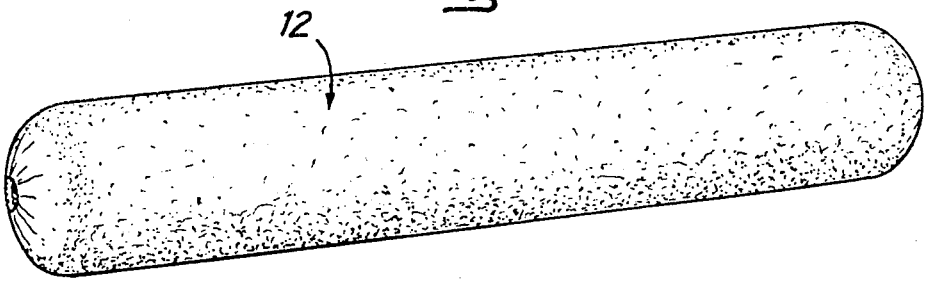
FIGS. 4 to 6 are perspective views showing various other articles in accordance with the invention.

There is shown in FIG. 4 an elongated cushion 12 which has a circular cross-section and is obtained by means of a foam block having the same shape and fitted in a corresponding cover.

Figure 5:
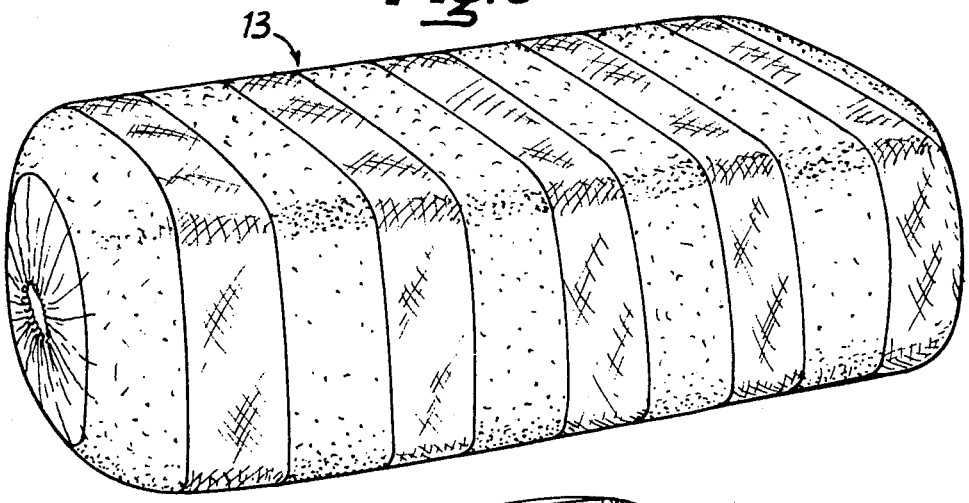

The squab 13 of FIG. 5 has been obtained by means of an elongated foam block of parallelepipedal shape and a cover of the same type as the cover of FIG. 2.

Figure 6:
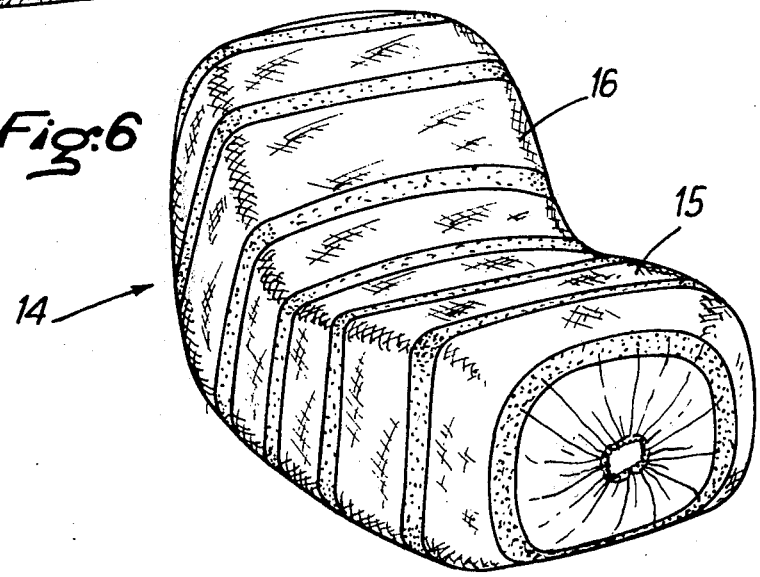

The article 14 shown in FIG. 6 is a seat consisting of a seat portion 15 proper and a back 16 which is inclined only at a small angle with respect to the seat portion. In the rest position, the foam block has a similar shape, the sharp edges of which are flattened by the cover.

It is readily apparent that the invention is not limited to the embodiments described in the foregoing and that it would possible on the contrary to devise a number of alternative forms without thereby departing either from the scope or the spirit of the invention.

What I claim is:

1. In an article of furniture such as a seat, pouffe, sofa or cushion, the combination comprising, a. a block of foam reproducing the general shape of the article, b. a covering made of fabric which is sufficiently elastic in at least one direction to deform the said block of foam, c. said covering being formed in the shape of a rectangular tube, d. said tube being open at both ends and provided with a closure means at each end, e. said elasticity of said covering being in a direction transverse to the axis of said tube, f. said covering being smaller than the block of foam to compress the foam when inserted into said block, g. said closure means drawing the end of the covering over the exposed end of the block foam to conceal said foam.

* * * * *